United States Patent [19]

Gregg

[11] Patent Number: 4,683,697

[45] Date of Patent: Aug. 4, 1987

[54] ROOFING TILES

[76] Inventor: Arthur H. Gregg, RR #3, Orillia, Ontario, Canada, L3V 6H3

[21] Appl. No.: 828,369

[22] Filed: Feb. 11, 1986

[51] Int. Cl.[4] ..... E04D 3/30; E04D 3/365

[52] U.S. Cl. ..... 52/520; 52/534; 52/543

[58] Field of Search ..... 52/518–520, 52/534, 531, 537, 560, 528, 543

[56] References Cited

U.S. PATENT DOCUMENTS

| | | | |
|---|---|---|---|
| 117,855 | 8/1871 | Belt | 52/519 |
| 468,126 | 2/1892 | Bellino | 52/518 |
| 502,552 | 8/1893 | Detombay | 52/537 |
| 525,098 | 8/1894 | Friedel | 52/534 |
| 943,888 | 12/1909 | Pedlar | 52/531 |
| 1,125,414 | 1/1915 | Vogan | 52/534 |
| 1,140,835 | 5/1915 | Kohr | 52/519 |
| 1,613,302 | 1/1927 | Whiteside | 52/519 |
| 3,510,278 | 5/1970 | Alleaume | 52/560 |

*Primary Examiner*—James L. Ridgill, Jr.
*Attorney, Agent, or Firm*—Sim & McBurney

[57] ABSTRACT

A roofing tile of malleable sheet material includes flat rectangular panels and V-shaped inverted ridges along each side edge of each panel. An outwardly and downwardly sloping first marginal panel is contiguous with one end edge, and an outwardly and upwardly sloping second marginal panel is contiguous with the other end edge. A third marginal panel extends from the outer margin of the second marginal panel, parallel with the flat rectangular panel. Each raised ridge is downwardly inverted at one end to define two quasi-parallelogram panels meeting at a join line which is an inverted part of the apex of the ridge. Each raised ridge is also upwardly inverted at its other end, to provide two further quasi-parallelogram panels meeting at a further join line which is an inverted part of the apex of the ridge. At the downwardly inverted end of the ridge, two triangular panels are contiguous with each pair of quasi-parallelogram panels, and are in planes spaced downwardly from and parallel to the flanks of the ridge. The first-mentioned quasi-parallelogram panels and the triangular panels define a watershed socket which nests with another watershed socket defined between the further quasi-parallelogram panels and the upper end of the ridge, to provide a sheltered location where a simple nail can be driven through to secure two tiles at once.

5 Claims, 4 Drawing Figures

ROOFING TILES

This invention relates generally to roofing tiles, and has particularly to do with a roofing tile capable of being made from a sheet of malleable material such as galvanized iron, formed in such a way as to be usable with other like tiles to cover and protect the flank of a typical sloped roof.

BACKGROUND OF THIS INVENTION

Sheet metal roofing tiles or panels are a well-known alternative to the conventional shingles. Such tiles or panels are typically of aluminum or galvanized iron, and numerous designs have been developed and patented.

U.S. Pat. No. 117,855, issued Aug. 8, 1871 to W. S. Belt and U.S. Pat. No. 502,552, issued Aug. 1, 1893 to B. B. Detombay are exemplary of early patents which incorporate longitudinal ribbing for increased strength and for water-tightness. Additional early patents are U.S. Pat. No. 1,140,835, issued May 25, 1915 to W. H. Kohr, and U.S. Pat. No. 1,613,302, issued Jan. 4, 1927 to B. F. Whiteside.

The above and numerous other prior art patents directed to ribbed sheet metal tiles suffer from two primary disadvantages. The first relates to the way in which the tiles are to be fastened to the roof boards. With the conventional smaller shingles, of course, the individual shingles can be set in such a way that the fastening nails for one row of the shingles are covered by the lower portions of the next upper row of shingles. However, for the large-size sheet metal tiles or panels, it is considered important to fasten the tiles at least along the upper edge and the lower edge. For some tiles which have a particularly large dimension between the upper and lower edges, intermediate nailing is also utilized. However, because of the nature of the sheet metal tiles or panels, one does not achieve a natural seal of the metal tile around the shank of the nail, and ordinarily some form of sealing washer or the like is applied under the head of the nail before it is driven home, thus tending to prevent ingress of water. Such special washer-equipped fasteners are of course expensive, and considerable economy would result by eliminating the necessity to use such fasteners.

Another disadvantage of the prior art as exemplified in the patents mentioned previously relates to appearance. There is a natural beauty and attractiveness in the old-style clay or wooden roofing shingles which resulted from the fact that the shingles were quite thick, thus giving a distinct "stepped" appearance to the roof contour. By contrast, the very thin sheet metal tiles and panels are not able to provide this stepped appearance, and are not as aesthetically pleasing.

Some tile designs capable of presenting this "stepped" configuration have been protected by patent or industrial design, and among these are Canadian Industrial Design Registration No. 42842, issued Oct. 31, 1977 to Rolls Gerard Tile Company Ltd., and Canadian Industrial Design Registration No. 40522, issued Apr. 5, 1976 to Kangaroo Roofing Ltd. However, these designs still have the previously described disadvantage relating to the technique for fastening the tiles against the roof panelling in an inexpensive but water-tight manner.

A further Canadian Industrial Design Registration No. 47030 was issued on June 30, 1980 to Bremat Systems Ltd., and disclosed an attractive sheet metal roofing tile capable of presenting a stepped appearance when a plurality of the tiles are used to cover a roof surface. However, the tile of the latter design is not adapted to be secured by simple nails (without sealing washers) both along the top edge and along the bottom edge in a secure fashion.

GENERAL DESCRIPTION OF THIS INVENTION

Accordingly, it is an aim of an aspect of this invention to provide a roofing tile adapted for fabrication from a sheet of malleable material, the roofing tile being capable of exhibiting a stepped appearance when utilized with other like tiles on a roof bank, and being such as to enable it to be secured against the roof bank utilizing simple nail-type fasteners along both the upper and lower edges, the fasteners being positioned at locations which are sheltered from falling rain, thus minimizing leakage.

More particularly, this invention provides a roofing tile comprising a sheet of malleable material formed so as to define at least one flat rectangular panel having two side edges and two end edges, a raised ridge along each side edge, at least some of said raised ridges being substantially an inverted "V" in section taken perpendicular to the respective side edge, thus defining two flanks, an outwardly and downwardly sloping first marginal panel contiguous with one end edge, an outwardly and upwardly sloping second marginal panel contiguous with the other end edge, the second marginal panel having an outer edge, a third marginal panel substantially parallel with said flat rectangular panel and contiguous with said outer edge of the second marginal panel, each raised ridge being downwardly inverted, at its end adjacent the first marginal panel, along a V-shaped fold line which lies in a plane oblique to the rectangular panel with the apex of the fold line directed toward the said other end edge, the inverted ridge flanks providing two quasi-parallelogram panels meeting at a join line which is an inverted part of the apex of the ridge, two substantially triangular panels contiguous with each pair of quasi-parallelogram panels, the triangular panels being in planes spaced downwardly from, but substantially parallel with, the flanks of the respective ridge, each raised ridge being upwardly inverted, at its end adjacent the second marginal panel, along a further V-shaped fold line which lies in a plane oblique to the rectangular panel with the apex of the further fold line directed away from said one end edge, the inverted ridge flanks providing two further quasi-parallelogram panels meeting at a further join line which is an inverted part of the apex of the ridge.

GENERAL DESCRIPTION OF THE DRAWINGS

One embodiment of this invention is illustrated in the accompanying drawings, in which like numerals denote like parts throughout the several views, and in which.

DETAILED DESCRIPTION OF THE DRAWINGS

Figure 1:
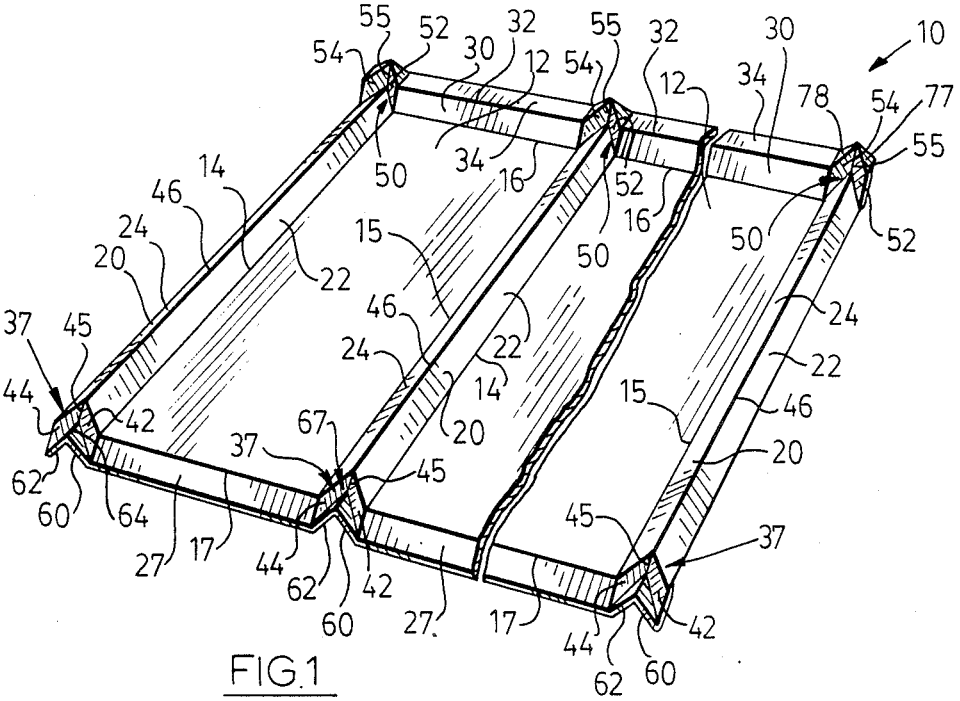
FIG. 1 is a perspective view of a roofing tile constructed in accordance with this invention.
Figure 2:
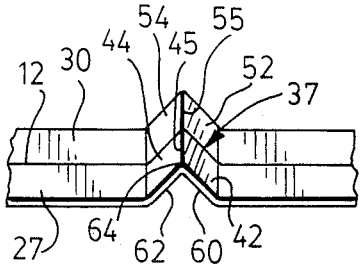
FIG. 2 is a partial elevational view looking into the forward or lower edge of the tile.
Figure 3:
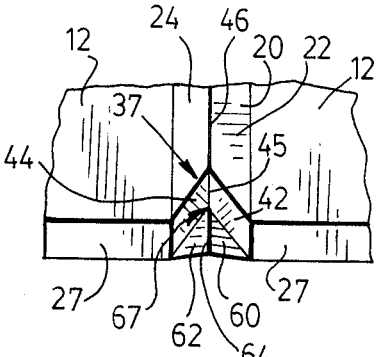
FIG. 3 is a partial plan view of the same portion as is shown in FIG. 2.

As can be seen in FIG. 1, a roofing tile 10 is made from a sheet of malleable material such as aluminum or galvanized iron, formed so as to define a plurality of flat rectangular panels 12, each having two side edges 14 and 15, and two end edges 16 and 17. The tile includes a plurality of raised ridges 20 between adjacent pairs of panels 12, whereby there is a raised ridge 20 along each side edge of each panel 12. Each raised ridge 20 is substantially an inverted "V" in section taken perpendicular to its respective side edge or edges. Thus, each ridge 20 defines two flanks 22 and 24.

Along the nearer end edge 17 of each rectangular panel 12 is an outwardly and downwardly sloping first marginal panel 27 which is contiguous with the nearer edge 17 of its respective rectangular panel 12. Each first marginal panel 27 thus defines an obtuse angle with its respective rectangular panel 12.

The tile further includes, for each rectangular panel 12, an outwardly and upwardly sloping second marginal panel 30 which is contiguous with the other end edge 16 of each rectangular panel, each second marginal panel 30 having an outer edge 32. Finally, for each rectangular panel 12 there is a third marginal panel 34 which is substantially parallel with its respective rectangular panel 12, and is contiguous with the outer edge 32 of the second marginal panel 30. It will be appreciated that all of the panels 12, 27, 30 and 32 are integral with each other at suitable fold lines.

Each raised ridge 20 is downwardly inverted, at its end adjacent the first marginal panel 27, along a V-shaped fold line 37 which lies in a plane oblique to the rectangular panel 12, with the apex of the fold line 37 being directed generally toward the edge 16 of the rectangular panel 12. The inverted ridge flanks 22 and 24 provide, respectively, two quasi-parallelogram panels 42 and 44 which lie in steeply inclined planes, and which meet at a join line 45 which is simply an inverted part of the apex 46 of the respective ridge.

In a similar manner, each raised ridge 20 is upwardly inverted, at its end adjacent the second marginal panels 30, along a further V-shaped fold line 50 which lies in a plane oblique to the rectangular panel 12 with the apex of the further fold line 50 directed away from the nearer end edge 17. The ridge flanks 22 and 24 are thus upwardly inverted and define two further quasi-parallelogram panels 52 and 54, respectively, which meet at a further join line 55 which is again an inverted part of the apex 46 of the respective ridge 20.

Figure 4:
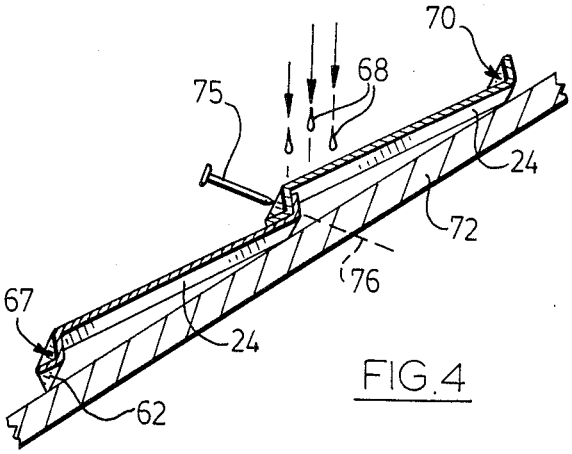
FIG. 4 is a vertical sectional view through a roof bank showing the tiles of this invention installed.

Looking at the nearer edge of the tile shown in FIG. 1, there are provided, contiguous with each pair of quasi-parallelogram panels 42 and 44, two substantially triangular panels 60 and 62, the triangular panels 60 and 62 being in planes spaced downwardly from, but substantially parallel with, the flanks 22 and 24, respectively, of the respective ridge 20. The two triangular panels 60 and 62 meet at a common join line 64, and where the latter meets the join line 45 between the two quasi-parallelogram panels 42 and 44 there is defined a watershed socket 67 which, as can be seen in FIG. 4, is positioned in such a way as to be sheltered from direct contact by vertically falling rain droplets 68. Along the upper edge of the tile 10, the junction between the apex 46 of each ridge and the respective join line 55 defines a further watershed socket 70, which will nest beneath the watershed socket 67 of the next upper tile, when the tiles are assembled together as seen in FIG. 4. Also seen in FIG. 4 is a roof board or panel 72, to which the tiles are to be secured. A nail or similar simple fastener 75 is shown in position, directed along the driving line 76 which it will follow as it is hammered into the nesting watershed sockets 67 and 70. Thus, the nail secures the upper edge of the lower tile and the lower edge of the upper tile simultaneously. Each such pair of nesting watershed sockets would receive a single nail, and this will securely fasten all tiles along both the upper edge and the lower edge.

(a) It will thus be appreciated that each tile is affixed to the roof with fastening members passing through the tile at the junction of the join line 45 and the first mentioned triangular panels 60 and 62, and (b) the junction of the join line 55 and the respective ridge.

It will be appreciated that the roofing tile may be constructed to have any desired number of rectangular panels 12. By way of a non-limiting example, a typical satisfactory panel construction is one which includes six panels 12 and measures approximately 6 feet wide (i.e. in the direction perpendicular to the ridges 20), and about 16 inches deep. Each rectangular panel 12 may measure approximately 6 inches across, by $13\frac{1}{2}$ inches deep.

Along the more distant edge of the tile 10 pictured in FIG. 1, there are provided two further substantially triangular panels 77 and 78 which are contiguous with the upper edges of the two further quasi-parallelogram panels 52 and 54.

The panel design of this invention is such that it can be stamped from a single piece of flat malleable sheet material such as aluminum or iron, thus not requiring any complicated peripheral outline, and also not wasting any material.

While one embodiment of this invention has been illustrated in the accompanying drawings and described hereinabove, it will be evident to those skilled in the art that changes and modifications may be made therein without departing from the essence of this invention, as set forth in the appended claims.

The embodiments of the invention in which an exclusive property or privilege is claimed are defined as follows:

1. A roofing tile comprising a sheet of malleable material formed so as to define at least one flat rectangular panel having two side edges and two end edges, a raised ridge along each side edge, at least some of said raised ridges being substantially an inverted "V" in section taken perpendicular to the respective side edge, thus defining two flanks, an outwardly and downwardly sloping first marginal panel connected to one end edge, an outwardly and upwardly sloping second marginal panel connected to the other end edge, the second marginal panel having an outer edge, a third marginal panel substantially parallel with said flat rectangular panel and connected to said outer edge of the second marginal panel, each raised ridge being downwardly inverted, at its end adjacent the first marginal panel, along a V-shaped fold line which lies in a plane oblique to the rectangular panel with the apex of the fold line directed toward the said other end edge, the inverted ridge flanks providing two quasi-parallelogram panels meeting at a join line which is an inverted part of the apex of the ridge, two substantially triangular panels connected to each pair of quasi-parallelogram panels, the triangular panels being in planes spaced downwardly from, but substantially parallel with, the flanks of the respective ridge, each raised ridge being upwardly inverted, at its end adjacent the second marginal panel, along a further V-shaped fold line which lies in a plane oblique to the rectangular panel with the apex of the further fold line directed away from said one end edge, the inverted ridge flanks providing two further quasi-parallelogram panels meeting at a further join line which is an inverted part of the apex of the ridge.

2. The invention claimed in claim 1, further comprising two further substantially triangular panels contiguous with said two further quasi-parallelogram panels.

3. A roofing tile as claimed in claim 1, which comprises a plurality of said flat rectangular panels, and a raised ridge between each adjacent pair of flat rectangular panels.

4. For use in covering a roof, a plurality of roofing tiles, each as claimed in claim 1, arranged so that the ridges run substantially along the maximum slope of the roof, each first marginal panel of a higher tile overlapping and lying above a second marginal panel of a next lower tile, the tiles being affixed to the roof with fastening members passing through each tile at (a) the junction of said join line and said first-mentioned triangular panels, and (b) the junction of said further join line and the respective ridge.

5. A roof for a building comprising:

a sloping roof bank, a plurality of roofing tiles, each as claimed in claim 1, the roofing tiles being positioned on the roof bank such that the ridges run substantially parallel with the line of maximum roof slope, each first marginal panel of a higher tile overlapping and lying above a second marginal panel of a next lower tile, the tiles being affixed to the roof with fastening members passing through each tile at (a) the junction of said join line and said first-mentioned triangular panels, and (b) the junction of said further join line and the respective ridge.

* * * * *